United States Patent [19]

Little, Jr. et al.

[11] 4,149,507

[45] Apr. 17, 1979

[54] FUEL-AIR RATIO CONTROL WITH TORQUE-LIMITING SPRING FOR SUPERCHARGED ENGINES

[75] Inventors: Joseph P. Little, Jr., Morton; John H. Parks, Peoria, both of Ill.

[73] Assignee: Caterpillar Tractor Co., Peoria, Ill.

[21] Appl. No.: 846,007

[22] Filed: Oct. 27, 1977

[51] Int. Cl.[2] ..... F02D 1/04; F02D 1/06

[52] U.S. Cl. ..... 123/140 FG; 123/140 MP

[58] Field of Search ..... 123/140 MP, 140 MC, 123/140 FG, 140 R, 139 AZ, 198 DB, 198 D; 92/84, 143; 417/214

[56] References Cited

U.S. PATENT DOCUMENTS

| | | | |
|---|---|---|---|
| 3,358,664 | 12/1967 | Thompson | 123/140 R |
| 3,707,144 | 12/1972 | Galis et al. | 123/140 R |
| 3,795,233 | 3/1974 | Crews et al. | 123/140 MP |
| 3,911,885 | 10/1975 | Hammond | 123/140 R |
| 3,916,862 | 11/1975 | Clouse et al. | 123/140 MC |

*Primary Examiner*—Carlton R. Croyle
*Assistant Examiner*—Thomas I. Ross
*Attorney, Agent, or Firm*—Phillips, Moore, Weissenberger, Lempio & Majestic

[57] ABSTRACT

An improved fuel-air ratio control apparatus for a supercharged engine having a governor means connected to a fuel adjusting member and a supercharger for supplying air through an intake manifold is disclosed. The control apparatus is directly engageable with the fuel adjusting member and is responsive to intake manifold air pressure and engine oil pressure. The apparatus is inoperative to restrain the adjusting member during start-up of the engine and remains so until such time as a predetermined intake manifold pressure is attained, at which time the control apparatus moves to a position which permits the metering of engine oil therethrough to permit normal governor operation and proportional increases of fuel with air pressure increased. The control apparatus thereafter automatically limits the fuel supplied to the engine, and therefore engine torque rise, during a decrease in engine speed caused by loading on the engine to thereby limit any undesired exhaust smoke. The improvement relates to the amount of torque reduction available from two torque reducer springs, and to the new means for adjustment of the rate of torque reduction using jam nuts.

6 Claims, 4 Drawing Figures

FUEL-AIR RATIO CONTROL WITH TORQUE-LIMITING SPRING FOR SUPERCHARGED ENGINES

BACKGROUND OF THE INVENTION

This invention relates to a fuel-air ratio control apparatus for overriding an engine governor means to preclude an increase of fuel to the engine during a reduction of air pressure in the engine intake manifold. Engines equipped with superchargers smoke badly under lug. Lug is encountered when resistance or load on the engine is increased to the extent that engine speed is reduced below that which is indicated by the governor setting. Under these conditions, the engine governor attempts to regain the engine speed indicated by the governor setting by automatically advancing the engine fuel rack to supply more fuel. However, due to the reduction in supercharger speed caused by the reduced engine speed, insufficient air is supplied to the engine to support complete combustion of the additional fuel being injected. The patent to Crews, et al, U.S. Pat. No. 3,795,233, of common assignment herewith teaches a fuel-air control apparatus for resolving the problems as described above. However, it was found that even with this control apparatus, excessive amounts of secondary exhaust plumes were still being generated during engine lug.

SUMMARY OF THE INVENTION

The present invention is directed to overcoming one or more of the problems as set forth above. According to the present invention, an improved fuel-air ratio control apparatus is disclosed for supercharged engines having a governor connected to a fuel control member and a supercharger supplying air through an intake manifold to the engine. The present invention includes an integral servo piston and valve unit placed in a restraining relationship with respect to the fuel control member. The servo piston is activated by a fluid force controlled by movement of a valve spool. This spool slides in an opening and closing manner relative to ports in a portion of the servo piston. The valve spool is secured to a pressure responsive mechanism which communicates with the engine intake manifold. The improvement comprises using resilient means including an adjustable stop means to control the amount of restraint imposed on the fuel adjusting member during engine lug.

In operation, during engine start-up the valve spool and ports of the servo piston are in an open position to render the servo unit inoperative and to permit unrestricted operation of the fuel adjusting member. The servo unit is subsequently activated when a predetermined increase in manifold air pressure shifts the valve spool relative to the servo piston ports and blocks and meters a flow of hydraulic fluid to the servo piston. During subsequent reductions in manifold air pressure, the servo unit is effective to restrain the fuel adjusting member against movement towards an increased fuel position. The restraint of the fuel adjusting member precludes any disproportionate increases in fuel to the engine when the air available in the intake manifold is insufficient to support proper fuel combustion. The resilient means comprises a plurality of springs whose spring rate additively determines the torque rise reduction enabled through limitation of the increasing fuel flow to the engine during engine lug. The adjustment means provides means for enabling variation of the point at which one of the torque reduction springs is engaged. This torque reduction spring is preloaded so as to prevent rattling of the spring when not engaged.

Therefore, it is an object of the present invention to provide an improved fuel-air ratio control apparatus wherein secondary exhaust emissions during engine lug are minimized.

Another object of the present invention is to provide an improved fuel-air ratio control apparatus for overriding the governor and control the injection of fuel to a supercharged engine as a function of a plurality of torque reduction springs, including a means for adjusting when a second torque reduction spring is to take effect.

A further object of the present invention is to provide an improved governor overriding fuel-air ratio control apparatus which is responsive to intake manifold air pressure with the control apparatus automatically permitting unrestricted movement of the fuel adjusting member during start-up to insure sufficient fuel for dependable starting, but thereafter automatically restricting the injection of fuel to the engine.

Other objects and advantages of the present invention will become more readily apparent upon reference to the accompanying drawings and the following description.

DESCRIPTION OF THE PREFERRED EMBODIMENT

Figure 1:
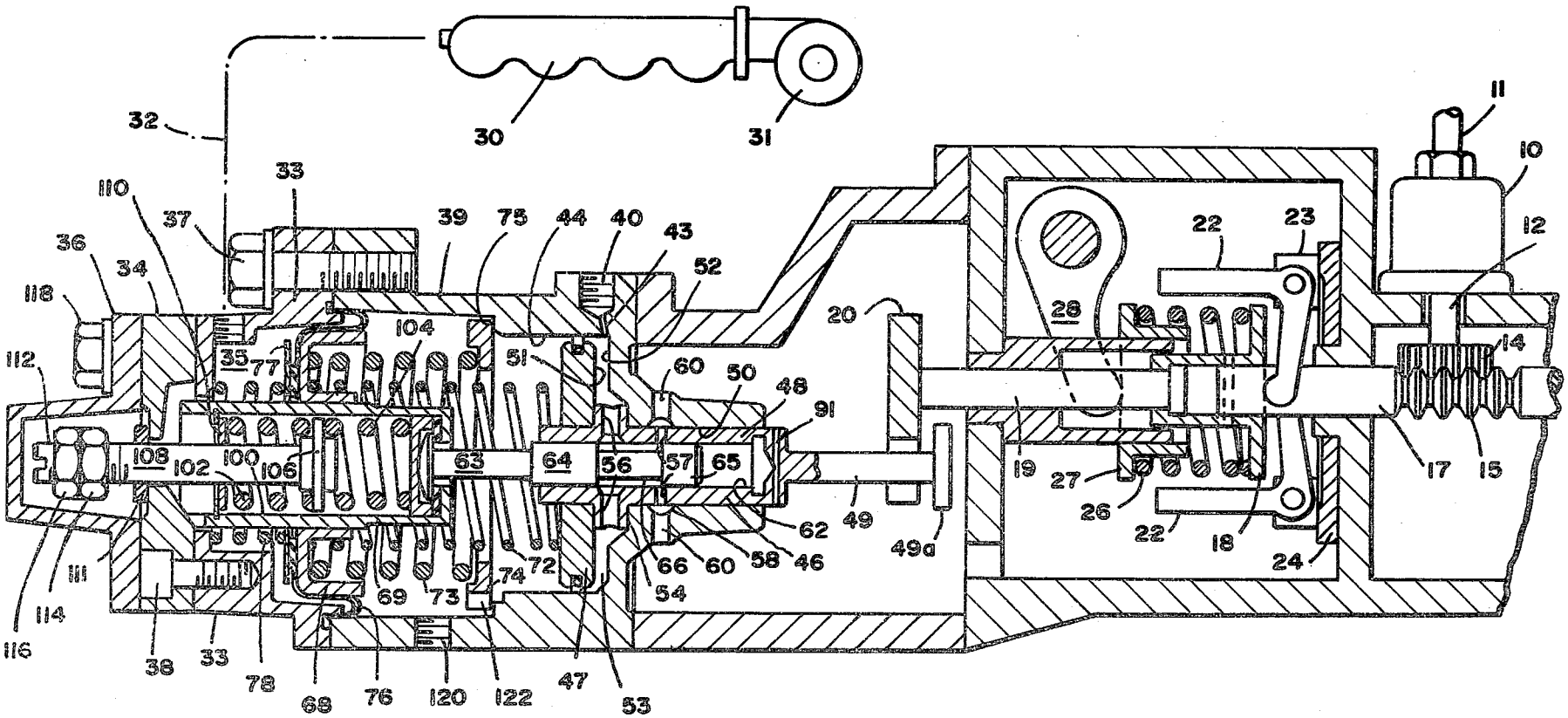
FIG. 1 is a longitudinal vertical section through the fuel-air ratio control apparatus of the present invention also schematically illustrating a supercharged engine intake manifold, a governor, and a fuel pump mechanism with the control apparatus being shown in an engine start condition.

Referring particularly to FIG. 1, a fuel pump 10 has a plunger 12 which is vertically reciprocal during engine operation to supply fuel through a fuel injection line 11 to one of the cylinders of the engine, there being one pump for each engine cylinder. Longitudinal movement of a fuel adjusting member 17 having rack teeth 15 moves a gear 14 secured to plunger 12. The pump is of the metering type in which angular adjustment of the plunger 12 results in a variation of the quantity of fuel injected upon each stroke.

The fuel adjusting member 17 is secured to a riser 18 having an extended link 19 with a stop member 20 attached at its distal end. A pair of flyweights 22 carried upon a yoke 23 are driven by a gear 24 which is rotated by the engine's timing gear (not shown) at a speed proportional to engine speed. Radially outward movement of the flyweights due to centrifugal force causes portions of the flyweights to act leftwardly upon the riser 18. A spring 26, disposed between the riser and a collar 27, opposes the biasing action of the flyweights. A movable lever 28 is positioned to provide a predetermined selectable preload force for the spring 26 to act against the force of the flyweights 22.

An engine air intake manifold 30 is supplied with air pressure by an engine driven supercharger 31. A conduit, shown schematically at 32, communicates the intake manifold with a chamber 35. Chamber 35 is formed in part by an adaptor 33 secured by bolts 37 to a control housing 39, and a shaft housing 34 secured by bolts 38 to the adaptor 33. A further cover 36, described in more detail below, is secured over the shaft housing 34.

Control housing 39 has an inlet 40 connected to a source of pressurized fluid, such as engine lubrication oil. An orifice 43 communicates inlet 40 with a bore 44 formed in the housing 39. A servo unit 46 has a piston portion 47 slidable within bore 44 and a valve portion 48 integral with the piston portion 47 and slidable within a bore 50 formed in the housing. A valve means is provided by said valve portion 48 in combination with a valve spool 63. The valve portion 48 also includes an extending portion 49 with a shoulder 49*a* thereon which is positioned to engage the stop member 20 under conditions to be explained hereinafter. An expansable chamber 53 is formed by a face 51 of the piston 47, a surface 52 of housing 39, and bore 44. Orifice 43 is positioned such that fluid from inlet 40 is permitted to enter chamber 53. Shoulders 54 on the servo unit 46 provide the means for enabling the fluid from orifice 43 to be communicated to the chamber 53 when the piston portion 47 is in its rightmost position within bore 44.

A first set of passages 56 in the valve portion 48 communicate the chamber 53 with a bore 62 in the servo unit. A second set of passages 57 in the valve portion 48 communicate the bore 62 with an annular groove 58 formed in the bore 50. This annular groove, in turn, is intersected by drain passages 60 in housing 39. Another passage 91 is provided to communicate to the drain any fluid which might leak through the servo unit.

The valve spool 63, slidable in the bore 62, has an annulus 66 formed between a pair of lands 64 and 65. When the land 64 is disposed as shown in FIG. 1, the passages 56 are open. Land 65 is similarly disposed so that the passages 57 are open and chamber 53 is in communication with the drain passages 60.

The valve spool 63 is secured to an annular cup member 68 by means of a cylindrical member 69. A first spring member 72 having a first spring rate, is disposed between the piston 47 and the cup member 68. A second spring member 73, having a second spring rate, is disposed between the cup member 68 and an annular seat member 74. The seat member 74 is positioned on an annular shoulder 75 defined within the housing 39. A diaphragm 76 is secured between the adapter 33 and the housing 39 and is supported by the cup member 68. A washer 77 disposed adjacent to and rearwardly of the diaphragm 76 acts as a seat for a third spring member 78 which resides between the adapter 33 and the washer 77. The rates of the three above described spring members are such that forces on the diaphragm are balanced when no air pressure is extant in the chamber 35 to provide sensitivity in the servo unit.

The cylindrical member 69 includes a bore 100 defined therein. Fourth and fifth spring members 102 and 104 are positioned within the bore 100, with a spacer 106 defined on a rod or shaft 108 separating the two springs 102 and 104. The base of cylindrical member 69 provides a seat for the valve spool 63 which thereby provides the opposite seat for the spring 104. A seat 110 is formed in the bore 100 to provide a seat for spring 102. The rod 108 extends through a shoulder opening 111 in the shaft housing 34. At its end, the rod 108 defines a threaded portion 112. Two jam nuts 114 and 116 are disposed on the threaded portion 112. The shoulder opening 111 is shaped such that it provides a stop means for the rod 108 after the rod has shifted to the right a predetermined distance. The cover 36, when secured by bolts 118 to housing 34, covers the rod portion extending through opening 111 and the jam nuts 114 and 116 threaded thereon. The jam nuts 114, 106 to provide means for adjusting the point at which the rod 108 is caused to be stopped by the shoulder opening 111, thus defining the predeterminable shifting distance for the rod 108, as described above. Therefore, only after the rod 108 and jam nuts 114, 116 have engaged the shoulder opening 111 stop, will the springs 102 and 104 have an affect on the operation of the control apparatus. At this point springs 102 and 104 will have an additive influence on the spring rate of spring 73. Note that spring 102 is preloaded by spring 104 so that both of these springs are loaded in all conditions to maintain a constant rate. More on the operative effect of springs 102 and 104 is given hereinbelow.

OPERATION

Prior to engine start-up, the fuel-air ratio control of the present invention assumes an inoperative position in the following manner. Spring member 72 urges the servo unit 46 towards the right, as shown in FIG. 1, and removes the shoulder 49*a* from engagement with stop 20. Any movement of the lever 28 in a counterclockwise direction compresses the spring 26 and moves the fuel adjusting member 17 rightwardly toward an overfueling position. During engine cranking or upon initial startup of the engine, the valve spool 63 is maintained in the position as shown. This enables communication between passages 56 and 57 through annulus 66 by means of the balanced condition of the spring members 73 and 78 acting upon the diaphragm 76. Fluid under pressure which enters chamber 53 from the inlet orifice 43 is drained off through passages 56 and 57, and 60 thus preventing exertion of a fluid force on the piston 47 and consequently leftward movement thereof.

Figure 2:
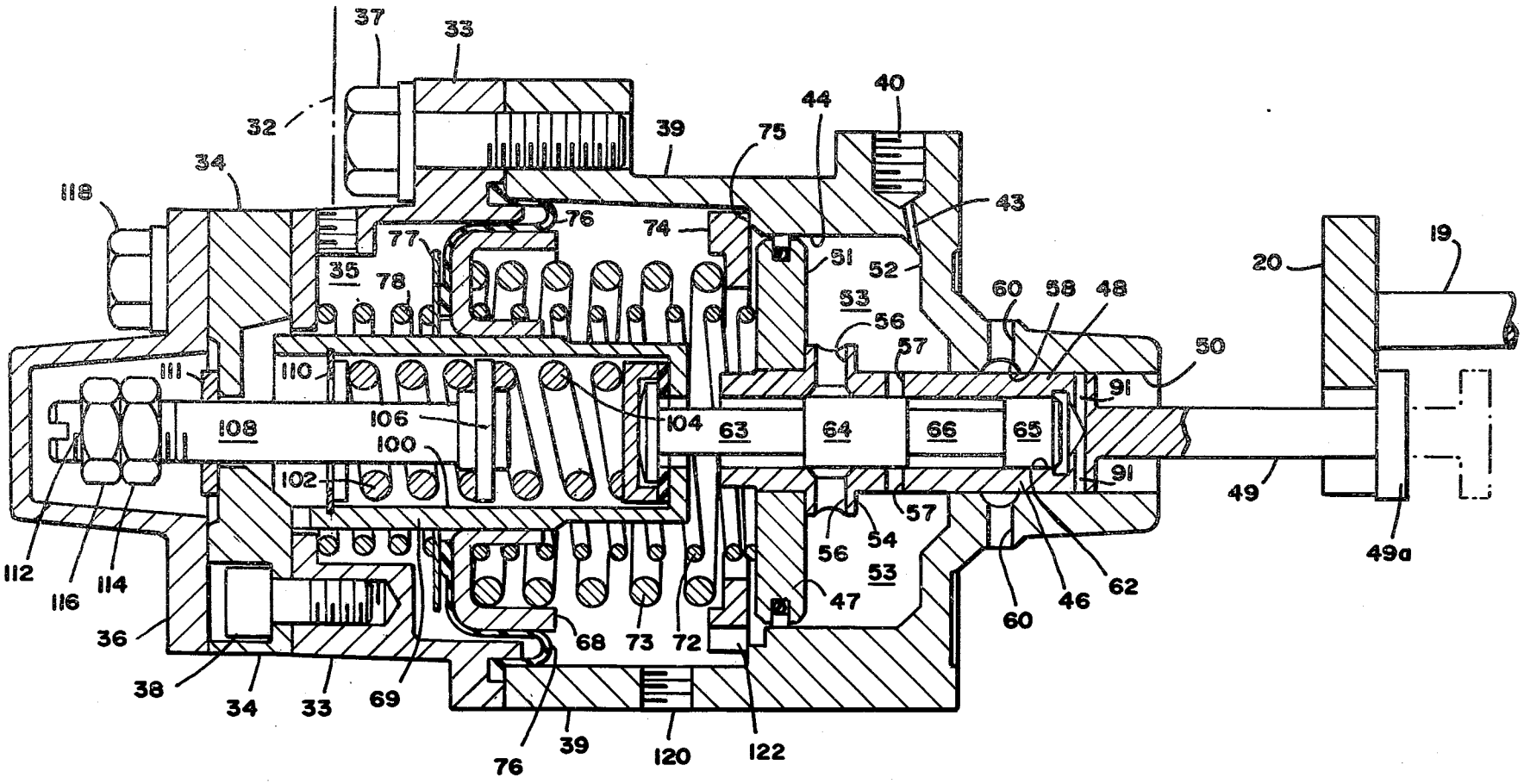
FIG. 2 is a longitudinal vertical section through the fuel-air ratio control apparatus of the present invention similar to FIG. 1, but omitting the governor and showing the fuel air ratio control device in the control operative position.

After the engine has been started and its speed has increased a predetermined amount, pressure in intake mainfold 30 builds up, generating a corresponding pressure build up in chamber 35. Consequently, the diaphragm 76 is acted upon as a function of the increasing air pressure in chamber 35. This tends to compress spring members 72 and 73 and to move the valve spool 63 towards the right. Such movement eventually causes the land 64 to cover passages 56. Fluid is thus prevented from draining from the chamber 53 and fluid pressure begins to build therein to force the piston 47 towards the left into a control operative position. During this leftward movement, the shoulder 49*a* may engage stop member 20 and move the fuel adjusting member 17 to a decreased fuel position. FIG. 2 illustrates the fuel air control apparatus in this control operative position.

Note that although the valve spool 63 has shifted to the right to a certain extent due to the air pressure in chamber 35 acting on the diaphragm 76, the jam nuts 114, 116 do not yet abut against the shoulder 111. As the air pressure in chamber 35 continues to increase, however, the jam nuts 114, 116 will abut the shoulder 111 which will act as a stop means to restrain further rightward movement of the shaft 108. Further discussion of the effect of this structure is given hereinbelow.

When the engine is operating at idle, as shown in FIG. 2, the air pressure in the intake manifold and in chamber 35 together with the bias of spring member 78, are not sufficient to completely overcome the bias of spring members 72 and 73 acting upon the diaphragm 76. So long as the jam nuts 114, 116 do not abut shoulder 111, springs 102 and 104 have no effect on the position of the valve spool 63. Thus, the valve spool 63 is restrained in a leftward position, since its position is controlled by the position of the diaphragm member 76. Further, the piston 47 is in the operative position wherein land 64 effectively restricts the passages 56 permit only a predetermined amount of fluid to be metered from chamber 53, to thereby maintain the piston 47 in the position shown in FIG. 2. The passages 57, as seen in FIG. 2, are out of alignment with annular groove 58 and the drain passages 60 to prevent fluid drainage therethrough.

As previously described, when the lever 28 is moved counterclockwise, the spring 25 is compressed to cause loading and movement of the fuel adjusting member 17 rightwardly toward an increased fuel position. However, with the fuel-air ratio control device operative, the spring member 73 and 78 would tend to position the valve spool 63 toward the left. Therefore, the servo unit 46 and the shoulder **49*a*** would permit only a slight movement of the fuel control member toward the increased fuel position.

As engine speed is increased from the low idle position indicated in FIG. 2, the air pressure in chamber 35 increases slightly to move the diaphragm 76 and thereby the valve spool 63 to the right. This causes the land 64 to move and slightly uncover the passages 56 to permit fluid to be metered out the opening, to drain through the outlet 120 via passages 122 in the seat member 74. Fuel adjusting member 17 would then be permitted to pull the servo unit to the right so long as the air pressure in chamber 35 was increasing and the valve spool 63 was moving rightwardly allowing thereby the valve means 48 to operate as above described.

Figure 3:
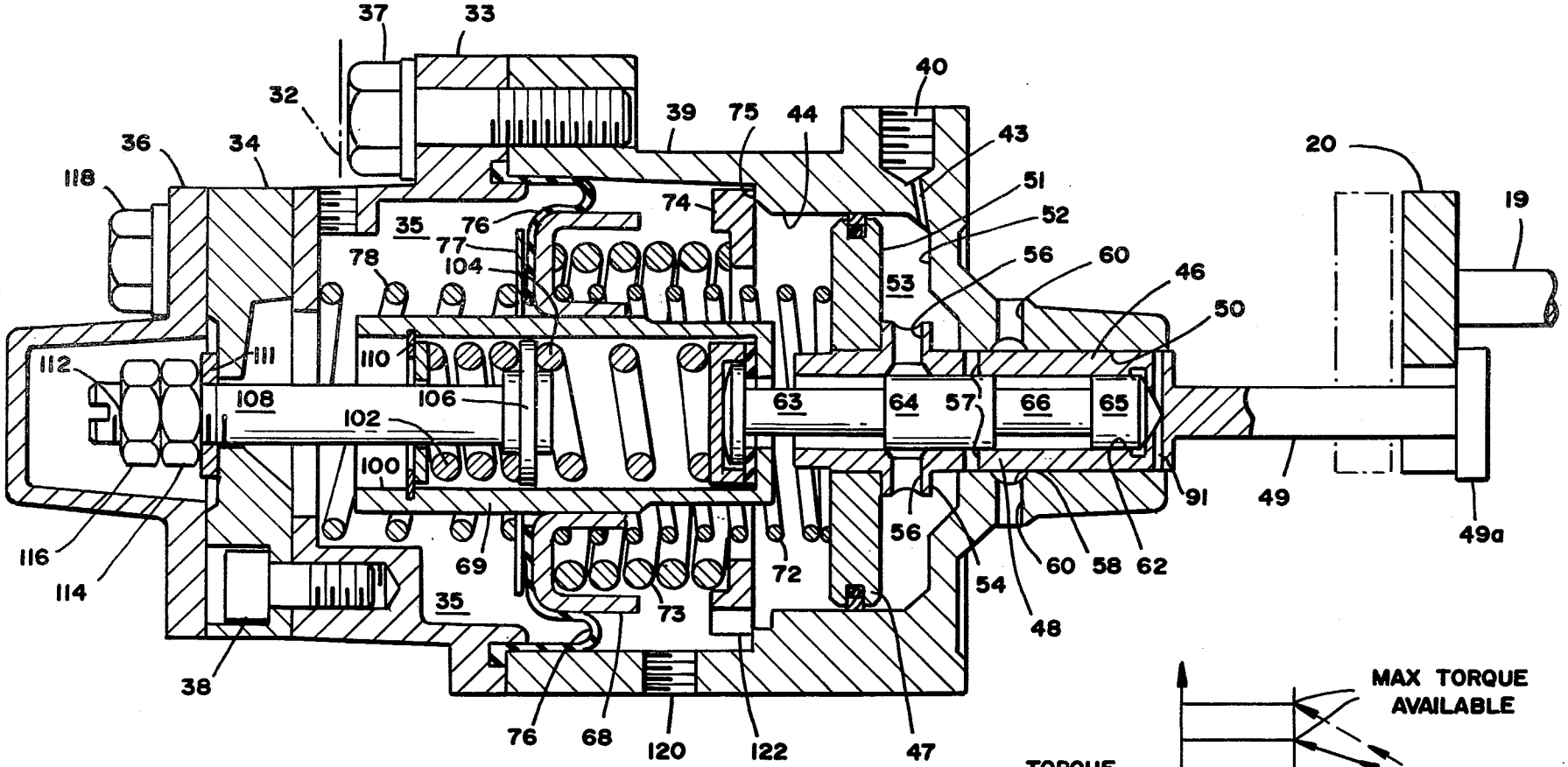
FIG. 3 illustrates a longitudinal vertical section through the fuel air ratio control apparatus of the present invention similar to FIG. 2, but showing the control device in the full engine load power position.

FIG. 3 illustrates the fuel air ratio control apparatus of the present invention with the control apparatus in a state corresponding to the engine operating at its rated full power condition. As the control apparatus approaches this state, with increasing engine speed and consequent increasing air pressure, the jam nuts 114, 116 abut the shoulder 111 such that the rightward movement of the valve spool 63 causes spring 102 and 104 to be deflected. This deflection is enabled by the spacer 106, coupled to the jam nuts via shaft 108, which acts as a seat for the springs 102 and 104. The rightward movement of the valve spool 63 is coupled to the spring 102 and 104 by means of the seat 110 which is operatively connected to the valve spool 63 by means of the cylindrical member 69. Therefore, with the control apparatus in its full power position as seen in FIG. 3, the rates of springs 102 and 104 have become an additive influence on valve spool 63 movement, i.e., to move to the right, the diaphragm and valve spool 63 must overcome the spring rates of springs 102 and 104 in conjunction with the spring rates of springs 73, 72 and 78.

During normal operation of the engine, within a predetermined load and speed range as determined by the governor flyweights 22, sufficient air will be available within the chamber 35 to maintain the fuel-air ratio control apparatus in a position which does not restrict the slight movements encountered by the governor in maintaining that speed. However, as mentioned above, when an increased load on the engine occurs, engine speed goes down, creating an engine lug condition. The governor then attempts to return the engine to its rated speed by advancing the fuel adjusting member 17. To prevent any disproportionate amount of fuel from entering the engine due to the insufficient air available at the lower engine speed to support full combustion of the fuel, the fuel-air ratio control apparatus restrains the fuel adjusting member 17 until the air pressure is sufficient to allow full fuel combustion.

The improved apparatus provides resilient means comprising two additional spring 102 and 104 which, in conjunction with springs 78, 72, and 73 restrain the fuel adjusting member 17 during this critical engine lugging period. As mentioned above, all of these springs interact at this engine speed range, so that as the air pressure in chamber 35 drops due to the reducing engine speed, these springs allow leftward motion of spool valve 63 and thus the servo unit 46 and associated shoulder **49*a* to cause a lesser amount of fuel to be supplied via the operation of the fuel adjusting member then in prior art fuel-air control devices. The position of the servo unit 46 is changed as a function of valve spool 63, since land 64 is caused to restrict the passages 56 as valve spool 63 moves to the left, thereby allowing fluid forces in chamber 53 to build up and cause piston 47 of the servo unit 46** to also move leftwardly.

Figure 4:
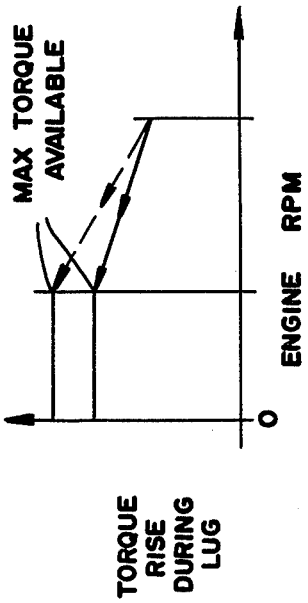
FIG. 4 illustrates the torque reduction available during engine lugging with the present apparatus as compared with the prior art.

To put the above description in different terminology, normally when the engine speed goes down into a lugging state due to an increased load, the torque supplied by the engine goes up. The rate of this torque rise during engine lug is a function of the amount of fuel supplied to the engine. That is, the less fuel supplied, the less the resultant rate of torque rise. The springs 102 and 104 act as torque limiter springs. FIG. 4 illustrates the torque reduction available from the combined springs 102 and 104 as compared with prior are fuel-air ratio control devices. The dotted line curve illustrates the prior art operation. Note that the maximum torque attainable from an engine is also reduced with the combined springs of the present invention. Note also that jam, nuts 114 and 116 enable the adjustment of the duration of the increased torque limiting effect caused by springs 102 and 104.

The Embodiments Of The Invention In Which An Exclusive Property or Privilege Is Claimed Are Defined As Follows:

1. In an engine having an intake manifold, a governor controlled fuel supply means, said fuel supply means having a control member means adapted to move in a first direction to increase the supply of fuel to the engine and in a second direction to decrease the supply of fuel to the engine, and improved override means for selectively overriding said governor to prevent movement of said control member means in said first direction, said override means including a piston means slidable within a first chamber means, a portion of said piston means being capable of directly contacting a portion of said control member means to thereby prevent movement of said control member means, diaphragm means movable within a second chamber means within said override means, first resilient biasing means physically disposed between said piston means and said diaphragm means for acting upon and biasing said piston means toward said first direction and for acting upon and biasing said diaphragm means towards said second direction, means for supplying fluid under pressure to said first chamber means to move said piston means toward said second direction against the bias of said first resilient means, valve passage means in said piston means for selectively draining off said fluid pressure from said first chamber to allow said piston means to move in said first direction, valve spool means connected to said diaphragm means for selectively opening and closing said valve passage means, means for communicating said intake manifold to said second chamber means to supply intake manifold pressure thereto to move said diaphragm means and said valve spool means toward said first direction in opposition to said first resilient biasing means, second resilient means for acting upon said diaphragm means and biasing said diaphragm means and said valve spool means toward said first direction, and third resilient means for biasing said diaphragm means and said valve spool means in said second direction, said improvement comprising:

a cylindrical member connected to said diaphragm means, said cylindrical member having a bore defined therein;

rod means reciprocally slidable within said bore;

stop means for operatively engaging said rod means after said rod means has travelled a predetermined distance in said first direction as a function of the position of said diaphragm means, thereby preventing further travel of said rod means in said first direction; and fourth resilient means operatively positioned within said bore such that said means acts to bias said cylindrical member and said diaphragm means in said second direction in addition to said second resilient means after said rod means has engaged said stop means.

2. The override means of claim 1 wherein said stop means comrises:

a shoulder opening for said rod means; and jam nut means threadably mounted on said rod means and operatively positioned to engage said shoulder after said rod means has travelled a predetermined distance in said first direction.

3. The override means of claim 2 further comprising means for adjusting said stop means, such that said predetermined distance of said rod means before engagement with said stop means may be varied thereby.

4. The override means of claim 1 further comprising fifth resilient means operatively positioned within said bore, said fifth resilient means acting as a means for providing preloading of said rod means and said fourth resilient means when said rod means has not engaged said stop means.

5. An improved fuel-air ratio control apparatus for an engine having a governor controlled fuel adjusting member means and a supercharger to supply air through an intake manifold to the engine, said control apparatus comprising resilient means responsive to intake manifold air pressure, valve means for reacting with said resilient means and for movement responsive to engine lubrication fluid pressure toward and away from said resilient means during normal governor controlled engine operation, said valve means being selectively engageable in interfering relation with said fuel adjusting member means for constraining movement of said fuel adjusting member means upon a reduction in manifold air pressure such that an optimum fuel-air ratio is assured for said engine and such that over-fueling is prevented during periods of reduced pressure in said intake manifold, said resilient means comprising a diaphragm means of resilient flexible material and a plurality of separate spring means arranged on opposite sides of said diaphragm means in a normally balanced relationship to said diaphragm means and selectively acting to hold said valve means in a non-interfering position with respect to said fuel adjusting member means, said improvements comprising:

a cylindrical member connected to said diaphragm means, said cylindrical member having a bore defined therein;

rod means reciprocally slidable within said bore;

stop means for operatively engaging said rod means after said rod means has travelled a predetermined distance as a function of the position of said diaphragm means, thereby preventing further travel of said rod means; and additional spring means operatively positioned within said bore such that said additional spring means acts to bias said cylindrical member and said diaphragm means to further constrain movement of said fuel adjusting member means upon a reduction in manifold air pressure after said rod means has engaged said stop means.

6. The fuel-air ratio control apparatus of claim 5 wherein said valve means further is disposed in a non-interfering relationship with said fuel adjusting member means during cranking of the engine, so that sufficient fuel is supplied to said engine upon starting in accordance with requirements set by the governor.

* * * * *